US006634480B2

(12) United States Patent
Peter et al.

(10) Patent No.: US 6,634,480 B2
(45) Date of Patent: Oct. 21, 2003

(54) DRIVING DEVICE

(75) Inventors: Cornelius Peter, Bühl (DE); Johann Von Der Heide, Schramberg (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 10/006,753

(22) Filed: Oct. 26, 2001

(65) Prior Publication Data

US 2002/0050437 A1 May 2, 2002

(30) Foreign Application Priority Data

Oct. 26, 2000 (DE) ..... 100 53 190

(51) Int. Cl.[7] ..... G05G 5/00
(52) U.S. Cl. ..... 192/224
(58) Field of Search ..... 192/224, 219.2, 192/33 R; 74/577 S; 188/30, 31, 60, 69, 82.7

(56) References Cited

U.S. PATENT DOCUMENTS 1,146,135 A 7/1915 Caughey et al.
1,875,417 A * 9/1932 Cirac ..... 192/219.2
2,079,106 A * 5/1937 Cirac et al. ..... 192/219.2
2,215,586 A * 9/1940 Hunter ..... 188/30
3,021,924 A * 2/1962 Patterson et al. ..... 188/82.7
3,744,760 A * 7/1973 Uher ..... 192/19

FOREIGN PATENT DOCUMENTS

DE 1142475 1/1963
DE 1605786 4/1971

* cited by examiner

*Primary Examiner*—Rodney H. Bonck
(74) *Attorney, Agent, or Firm*—Tarolli, Sundheim, Covell & Tummino L.L.P.

(57) ABSTRACT

The driving device has a rotatable drive disc (16) that is coupled to a motor (10) and, arranged coaxially with the drive disc, a locking disc (20) that can be rotated to a limited extent relative to the drive disc. The locking disc has detent teeth on its outer circumference. A pawl (30), is pivotally mounted on a stationary axis. The drive disc (16) is provided with a recess (28) on its outer circumference. The outer circumference of the drive disc extends radially beyond the tips of the detent teeth. The recess has a bottom of approximately the same radial depth as the gaps of the detent teeth. Together with the outer circumference of the drive disc (16), the recess (28) forms a cam on which the tip of the pawl (30) slides.

8 Claims, 1 Drawing Sheet

DRIVING DEVICE

The present invention relates to a driving device for use in an actuating drive in vehicles.

BACKGROUND OF THE INVENTION

Actuating drives are increasingly being installed in luxury vehicles for various convenience functions. These drives have the task of replacing manual activation or operation with an automated actuating function. Recently, the proposal has been made to replace the manual movement of the gearing shift lever of an automatic transmission by such an actuating function. Another proposal is for the engine hood to be moved by an actuating device. The actuating devices that are suitable for such applications must generate considerable forces and must function very reliably. This requirement can be fulfilled with an electric motor that is followed by a speed reduction gear. However, in case of a power failure in the car's electrical system, there still has to be a sufficient supply of energy to ensure minimum functionality. Moreover, a locking in certain positions is required.

Conventional driving devices cannot achieve these objectives.

BRIEF SUMMARY OF THE INVENTION

The present invention provides a sturdy, simple driving device adapted to generate high actuating forces and which allows locking in predefined positions as well as quick and reliable unlocking.

The driving device according to the invention comprises a rotatable drive disc that is coupled to a motor. Arranged coaxially the drive disc is a locking disc that can be rotated to a limited extent relative to the drive disc. On its outer circumference, the locking disc has detent teeth. A pawl is pivotally mounted on a stationary axis to interact with the detent teeth. The drive disc has a cam that can be engaged by the pawl. On relative rotation of the drive disc and the locking disc, the pawl is lifted out of the detent teeth. Preferably, the drive disc is provided with a recess on its outer circumference. The outer circumference of the drive disc extends beyond the tips of the detent teeth. The bottom of the recess has approximately the same depth as that of the gaps between the detent teeth. Together with the outer circumference of the drive disc, the recess forms a cam on which the tip of the pawl slides.

BRIEF DESCRIPTION OF THE DRAWING

Further advantages and features of the invention are found in the description below of a preferred embodiment and in the appended drawings, to which reference is made. The drawings show the following.

DETAILED DESCRIPTION OF THE PREFERRED EMBODIMENT

Figure 1:
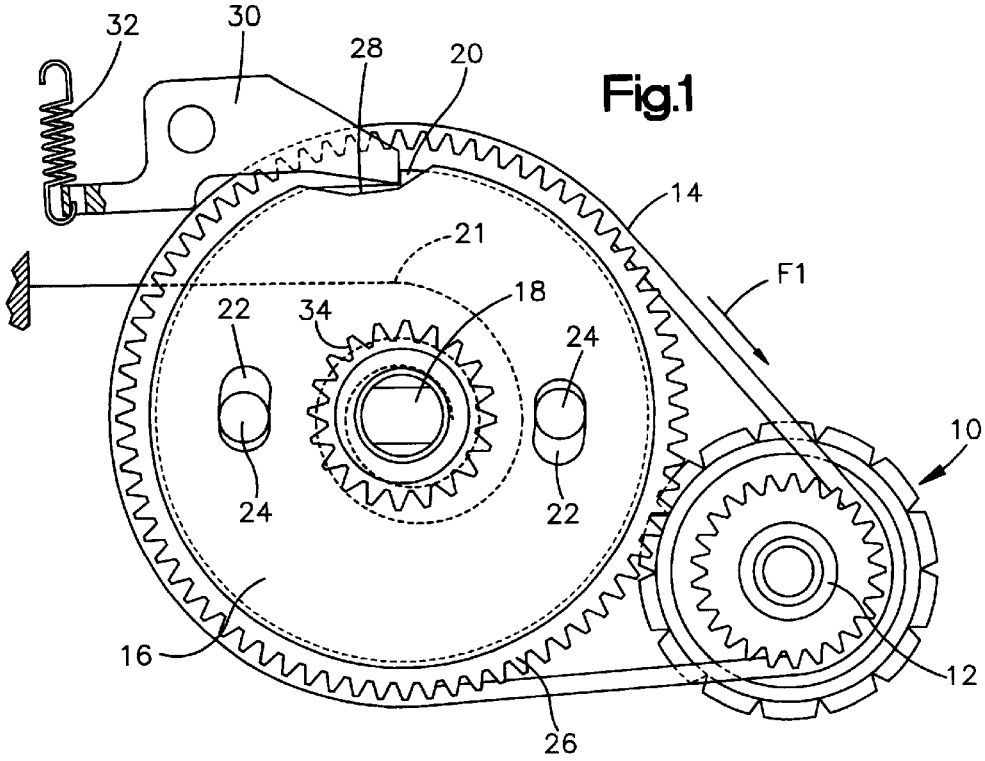
FIG. 1—a schematic side view of a driving device with a pawl in a locked condition.

An electric motor 10, which is preferably as a brushless, multipolar external rotor motor, is provided as a power source. Via a toothed belt wheel 12 and a toothed belt 14, the electric motor 10 drives a drive disc 16 that is mounted on an axis 18. A locking disc 20, which has detent teeth on its outer circumference, is coaxially and rotatably coupled to the drive disc 16 in such a way that relative rotation is limited to a small angle. For this purpose, the drive disc 16 has two elongated holes 22 into each of which a stud 24 engages that projects axially from the locking disc 20. Coupled to the drive disc 16, there is a toothed belt crown 26 that engages with the toothed belt 14. The outer circumference of the drive disc 16 extends radially beyond the tooth tips of the detent teeth on the outer circumference of the locking disc 20 across most of the circumference, except for a recess 28 in the circumference that forms a cam surface.

A pawl 30 that is pivotally mounted on a stationary axis is arranged adjacent the circumference of the locking disc 20 and of the drive disc 16. The pawl 30 is biased by a tension spring 32 to urge the tip of the pawl against the circumference of the drive disc 16 and simultaneously into engagement with the detent teeth of the locking disc 20. FIG. 1 shows the pawl 30 in the latched state. In the rotational position shown, the tip of the pawl 30 dips into the recess 28, whose bottom lies at about the same radial height as the depth of the gaps between the detent teeth. The axial width of the pawl 30 is such that it extends axially across the drive disc 16 and the locking disc 20.

The detent teeth on the circumference of the locking disc 20 have a saw-tooth shape, so that the tip of the pawl 30 locks on the steep tooth flanks but is deflected from the flat tooth flanks. Thus, the pawl 30 acts as a reverse lock that allows a rotation of the locking disc 20 with the drive disc 16 in one sense of rotation and blocks it in the opposite sense of rotation when the recess 28 faces the tip of pawl 30. In the configuration shown in FIG. 1, clockwise rotation is allowed and the opposite rotation is blocked.

The recess 28 is generally triangular, with an entry ramp and an exit ramp. The tip of the pawl 30 slides on the cam surface formed by the recess 28. Since the drive disc 16 in the embodiment shown has only one recess 28, the locking disc 20 can only be blocked by the pawl 30 in the rotational position shown in FIG. 1. Depending on the particular application, there are several recesses like the recess 28 arranged on the circumference of the drive disc 16 at predefined rotational angles.

A load is coupled to the locking disc 20. In one embodiment, the load is a flat spiral spring 21, which constitutes an energy storage means. Upon rotation of the locking disc 20 in the first sense of rotation, which is indicated in FIG. 1 by an arrow F1, the flat spiral spring 21 is tensioned, the pawl 30 being deflected from the detent teeth of the locking disc 20 so as not to resist such rotation. When the motor is switched off, however, the pawl 30 locks in the detent teeth of the locking disc 20, as soon as the recess 28 comes to lie opposite from it, as is shown in FIG. 1.

Figure 2:
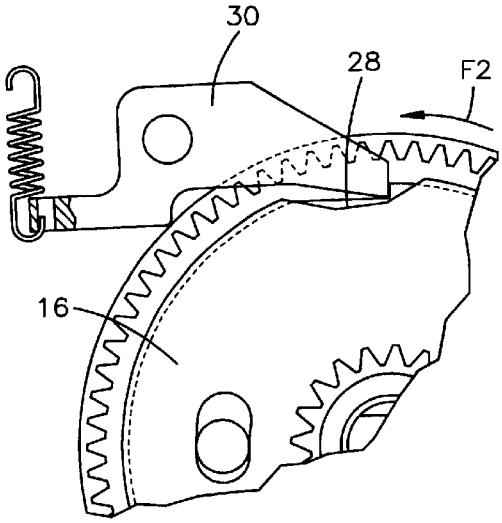
FIG. 2—a partial view of the device at the beginning of the lifting motion that releases the pawl.
Figure 3:
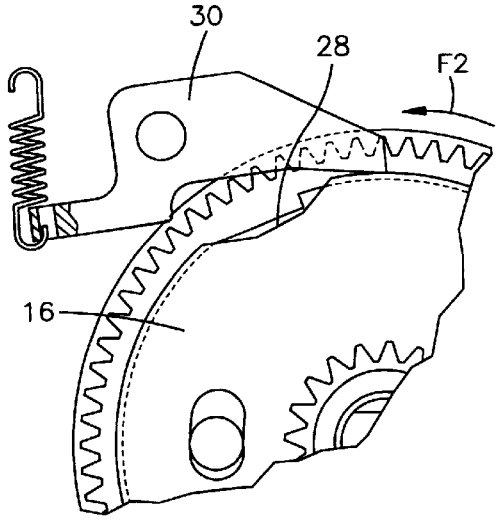
FIG. 3—a similar partial view of the condition when the pawl is completely unlocked.

In order to disengage the pawl 30 from the detent teeth, the drive disc 16 is driven in the opposite direction by means of motor 10, as indicated in FIGS. 2 and 3 by an arrow F2. The pawl 30, whose tip lies on the bottom of the recess 28, now moves to one ramp surface of the recess and is thus lifted. This process is illustrated in FIG 2.

When the drive disc 16 is rotated further in the direction indicated by the arrow F2, the pawl 30 is lifted completely out of the detent teeth of the locking disc 20 and now comes to lie on the outer circumference of the drive disc 16 as shown in FIG. 3. When a tensioned flat spiral spring 21 is coupled to the locking disc 20 as an energy storage means— as mentioned above—this spring, in turn, constitutes a power source with which the drive disc 16 is driven via the locking disc 20. In the embodiment shown, the drive disc 16 has a pinion 34 that serves for coupling to an actuating mechanism.

The driving device described can be referred to as a self-unlocking latch gearing. It is especially suitable for use in an actuating drive in vehicles, especially in an actuating means for moving the engine hood or an actuating means for moving the gearing shift lever of an automatic transmission. The energy storage means, which is loaded through the latch gearing, provides a mechanical power source in case of a power failure. The electric motor only has to be operated briefly and against a low load in order to lift the pawl, for which purpose a small power back-up, which is kept available in a storage capacitor, is sufficient.

What is claimed is:

1. A driving device comprising a rotatable drive disc coupled to a motor and a locking disc arranged coaxially with said drive disc and coupled with said drive disc for a limited relative rotation, said locking disc having circumferential detent teeth, and further comprising a pawl pivotally mounted on a stationary axis to interact with said detent teeth as a reverse lock, said drive disc having at least one cam means adapted to be engaged by said pawl when said pawl is latched with said detent teeth, said cam means of said drive disc, said detent teeth of said locking disc, and said pawl being arranged and configured to allow unlimited rotation of said locking disc, when interacting with said pawl, in a first sense of rotation and blocking rotation of said locking disc in a second sense of rotation being opposite to said first sense of rotation, rotation of said drive disc relative to said locking disc in said second sense of rotation causing said cam means to lift said pawl out of engagement with said detent teeth.

2. The device according to claim 1, wherein said pawl extends axially across said locking disc and said drive disc.

3. The device according to claim 1, wherein said locking disc is coupled to a load.

4. The device according to claim 1, wherein said drive disc and said locking disc are coupled to each other by at least one elongated hole in one of said discs and a stud on the other of said discs that engages into said hole.

5. The device according to claim 1, wherein said motor is coupled to said drive disc by means of a toothed belt.

6. A driving device comprising a rotatable drive disc coupled to a motor and a locking disc arranged coaxially with said drive disc and coupled with said drive disc for a limited relative rotation, said locking disc having circumferential detent teeth, and further comprising a pawl pivotally mounted on a stationary axis to interact with said detent teeth as a reverse lock, said drive disc having at least one cam means adapted to be engaged by said pawl when said pawl is latched with said detent teeth, rotation of said drive disc relative to said locking disc causing said cam means to lift said pawl out of engagement with said detent teeth, wherein said cam means are formed by a recess on the outer circumference of said drive disc, said outer circumference extending radially beyond the tips of said detent teeth, and said recess having a bottom of approximately the same radial depth as the gaps between said detent teeth, and said pawl having an engagement member that slides on the circumference of said drive disc.

7. A driving device comprising a rotatable drive disc coupled to a motor and a locking disc arranged coaxially with said drive disc and coupled with said drive disc for a limited relative rotation, said locking disc having circumferential detent teeth, and further comprising a pawl pivotally mounted on a stationary axis to interact with said detent teeth as a reverse lock, said drive disc having at least one cam means adapted to be engaged by said pawl when said pawl is latched with said detent teeth, rotation of said drive disc relative to said locking disc causing said cam means to lift said pawl out of engagement with said detent teeth, wherein said motor drives a load in a first sense of rotation via said drive disc and said locking disc coupled to said drive disc for joint rotation, and said motor drives said drive disc in the opposite sense of rotation to lift said pawl out of said detent teeth.

8. A driving device comprising a rotatable drive disc coupled to a motor and a locking disc arranged coaxially with said drive disc and coupled with said drive disc for a limited relative rotation, said locking disc having circumferential detent teeth, and further comprising a pawl pivotally mounted on a stationary axis to interact with said detent teeth as a reverse lock, said drive disc having at least one cam means adapted to be engaged by said pawl when said pawl is latched with said detent teeth, rotation of said drive disc relative to said locking disc causing said cam means to lift said pawl out of engagement with said detent teeth, wherein said locking disc is coupled to a spring force storage means which constitutes a drive source adapted to drive a load independent of said motor.

* * * * *